United States Patent [19]

Waki et al.

[11] 4,397,568

[45] Aug. 9, 1983

[54] TIMEPIECE PUSH-BUTTON STRUCTURE

[75] Inventors: Masahiko Waki; Hisao Yamagata; Toshio Murata; Fumio Takeuchi; Masataka Matsumoto, all of Tanashi, Japan

[73] Assignee: Citizen Watch Company Limited, Tokyo, Japan

[21] Appl. No.: 250,974

[22] Filed: Apr. 3, 1981

[30] Foreign Application Priority Data

Apr. 8, 1980 [JP] Japan ..... 55-46477[U]

[51] Int. Cl.[3] ..... G04C 17/00; G04C 3/00; G04B 19/30; G04B 37/00

[52] U.S. Cl. ..... 368/321; 368/69; 368/70; 368/308; 200/159 R; 200/159 A

[58] Field of Search ..... 368/319, 320, 321, 308, 368/70, 69, 224; 200/159 R, 159 A

[56] References Cited

U.S. PATENT DOCUMENTS

| | | | |
|---|---|---|---|
| Re. 29,551 | 2/1978 | Zurcher et al. | 368/70 |
| 4.059,956 | 11/1977 | Maeda et al. | 200/159 R |
| 4,072,004 | 2/1978 | Tanaka et al. | 368/69 |
| 4,322,833 | 3/1982 | Husted | 368/321 X |

*Primary Examiner*—J. V. Truhe
*Assistant Examiner*—Terry Flower
*Attorney, Agent, or Firm*—Jordan and Hamburg

[57] ABSTRACT

A timepiece push-button structure comprising a spring member composed of tongue portions interconnected by a connection portion, each tongue portion being bridge-shaped so that the central portion is raised while both end portions of the central portion abut against a pressure conductive rubber holder, each tongue portion further including a substantially centrally located arcuate notch and a bifurcation extending therefrom. A push-button having a groove is adapted to engage said notch, and a pressure conductive rubber is adapted for the application of pressure and disposed directly below the push-button.

3 Claims, 2 Drawing Figures

TIMEPIECE PUSH-BUTTON STRUCTURE

BACKGROUND OF THE INVENTION

This invention relates to timepiece push-button structures and, more particularly, to an improvement over the timepiece push-button structure.

Wristwatches have become increasingly thinner and now employ a plurality of push-buttons to cope with a diversification in available functions. A problem that arises in this connection is how to design a structure for a switch that will operate reliably in a very limited amount of space. Although timepiece cases now available are already quite thin, a further reduction in thickness on the order of 0.1 to 0.2 millimeter would be a major advantage in terms of design which is restricted by so may factors. The effect of such a reduction in thickness would be of significance if it could be accomplished without sacrificing such properties as the waterproof property of a timepiece.

Push buttons generally employ a coil spring and exhibit resilience which derives from the spring. In order to impact a coil spring with resiliency of a sufficient magnitude, however, the spring must be of a certain length and is generally possessed of a complicated structure. Conventional arrangements that employ a leaf spring exhibit inadequate resilience, and a C-ring (a circular spring with a portion thereof cut away) must be provided to prevent the push-button from falling out of the case. When the number of such push-buttons installed in the case is increased, the spacing between adjacent push-buttons is diminished so that the assembly operation becomes a problem.

SUMMARY OF THE INVENTION

An object of the present invention is to provide a push-button structure that reduces the number of component parts necessary for the installation of a plurality of push-buttons, thereby facilitating the assembly operation.

It is another object of the present invention to provide a timepiece push-button structure that will allow the push-button to operate reliably even in a very limited amount of space.

DESCRIPTION OF THE PREFERRED EMBODIMENTS

Figure 1:
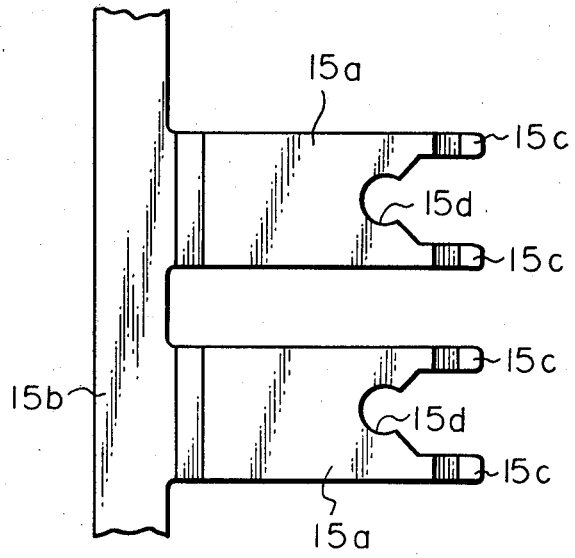
FIG. 1 is a plan view illustrating a portion of a spring member, forming part of a timepiece push-button structure according to the present invention.
Figure 2:
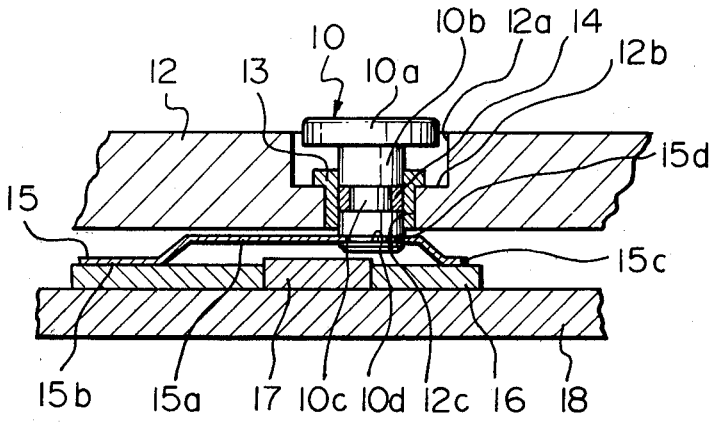
FIG. 2 is a cross-sectional view showing a preferred embodiment of the push-button structure in accordance with the present invention.

The present invention will now be described in conjunction with the drawings. Referring to FIGS. 1 and 2, there is shown a push-button structure for a timepiece having a case 12. The case 12 has a first bore 12*a*, an annular shoulder 12*b* and a second bore 12*c* smaller in diameter than the first bore 12*a*. A pipe 13 is press-fitted into the second bore 12*c* of the case 12. A push-button 10 has a head portion 10*a* and a stem portion 10*b* formed with a reduced diameter portion 10*c*. The stem portion 10*b* of the push-button 10 is slidably disposed in the pipe 13, and a sealing member such as an O-ring 14 is disposed between an inner wall of the pipe 13 and an outer periphery of the reduced diameter portion 10*c* of the stem portion 10*b* to provide a water-proofing effect therebetween. Numeral 15 designates a spring member in the form of a leaf spring having a plurality of tongue portions 15*a* which are interconnected by a connection or base portion 15*b*. The spring member is carried atop the upper surface of a pressure conductive rubber holder 16. The holder 16 is attached to an upper surface of a circuit board 18.

Each of the tongue portions 15*a* is bridge-shaped so that the central portion thereof is raised while the ends on both sides of the central portion abut against the pressure conductive rubber holder 16, one end being joined to the connection portion 15*b* and the other end being free. The free end of the tongue portion 15*a* has a bifurcation 15*c* whose root portion has a centrally located arcuate notch 15*d* that allows the root portion to perform the function of a C-ring. Specifically, when installing the spring member 15 the notch 15*d* is engaged with a groove 10*d* formed in the tip of the push-button 10 which will thus be lifted constantly by the central portion of the tongue portion 15*a* and prevented from falling out of the pipe 13.

A pressure conductive rubber 17 is held by the pressure conductive rubber holder 16. The pressure conductive rubber 17 is slightly thicker than the rubber holder 16 and protrudes by an amount equivalent to its allowable compression. The push-button 10 is situated above the boundary separating the pressure conductive rubber 17 from the pressure conductive rubber holder 16 so that, when the push-button 10 is depressed, the rubber 17 is compressed by the allowable amount to allow the tip of the push-button 10 to abut against the rubber holder 16 as well as the rubber 17.

In accordance with the push-button structure of the foregoing arrangement, depressing the push-button 10 allows the tip of the push-button to compress the pressure conductive rubber 17 to establish a conductive path. Further compression of the rubber 17 brings the tip of the push-button 10 into contact with the pressure conductive rubber holder 16 as well; no additional compression of the rubber 17 takes place beyond this point.

Next, when the push-button 10 is released, the push-button is lifted by the tongue portion 15*a* and restored to its original position. The push-button 10 will not fall out of the case or wobble as long as the spring member 15 is restored to its specified position by virtue of the engagement between the tongue portion 15*a* and the groove 10*d* provided in the push-button.

To remove the push-button 10, the spring member 15 is slid to the left as viewed in FIG. 2. This sliding action causes the notch 15*d* to spread so that the spring member 15 may disengage from the groove 10*d*. This removes the vertically directed restraint from the push-button so that it may be extracted from the case 12.

The push-button structure according to the present invention as described above comprises a push-button, a spring member, a strip of a pressure conductive rubber and rubber holder for holding the former rubber strip. Fewer component parts are needed in comparison with the prior art, and only a single spring member will suffice, even for a plurality of push-buttons. Since sufficient resiliency can be obtained merely by raising the central portion of the spring member slightly to provide the bridge-shaped configuration, space along the direction of push-button stroke is not required, in contradiction to conventional arrangements that rely upon coil springs. Moreover, assemblage is facilitated since the spring member is installed simply by pushing it in a given direction, with no C-ring being required.

The present invention provides a thinner switch structure of considerable practical value since the switch operates reliably even in a very limited space.

What is claimed is:

1. A push-button structure for a timepiece having a case and a circuit board, comprising:

a pressure conductive rubber which is rendered electrically conductive when applied with pressure;

a holder attached to an upper surface of said circuit board and holding said pressure conductive rubber in a fixed place;

a spring member attached to an upper surface of said holder and including a connection portion and a plurality of tongue portions interconnected by the connection portion, each of said tongue portions having a bridge-shaped central portion which is raised from said holder, and said spring member further including a substantially centrally located arcuated notch and a bifurcation extending therefrom; and a push-button slidably disposed in said case and having its end engaging said notch, the end of said push-button being located directly above said pressure conductive rubber to press said rubber when said push-button is depressed.

2. A push-button structure according to claim 1, in which said case has a bore, further comprising a pipe press fitted to the bore of said case, said push-button having a stem portion slidably received in said pipe.

3. A push-button structue according to claim 2, in which the stem portion of said push-button has a reduced diameter portion, and further comprising a sealing member disposed between the reduced diameter portion of the stem portion of said push-button and said pipe.

* * * * *